US006601508B1

(12) United States Patent
Chagnon

(10) Patent No.: US 6,601,508 B1
(45) Date of Patent: Aug. 5, 2003

(54) DEVICE FOR CLAMPING PRINTING FORMS IN CLAMPING CHANNELS OF REDUCED SIZE

(75) Inventor: Franck Chagnon, S'Lev d'Esserent (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/536,170

(22) Filed: Mar. 27, 2000

(30) Foreign Application Priority Data

Mar. 26, 1999 (DE) ..... 199 13 701
Jan. 19, 2000 (FR) ..... 00 00635

(51) Int. Cl.[7] ..... B41F 27/12
(52) U.S. Cl. ..... 101/415.1; 101/378
(58) Field of Search ..... 101/415.1, 378

(56) References Cited

U.S. PATENT DOCUMENTS

| | | | | |
|---|---|---|---|---|
| 3,276,364 A | * | 10/1966 | Langer | 101/415.1 |
| 3,727,551 A | | 4/1973 | Kostas et al. | 101/415.1 |
| 3,757,691 A | | 9/1973 | Etchell et al. | 101/415.1 |
| 5,213,038 A | | 5/1993 | Takahashi et al. | 101/415.1 |
| 5,423,258 A | * | 6/1995 | Weber | 101/415.1 |
| 5,526,747 A | | 6/1996 | Marmin et al. | 101/415.1 |
| 5,596,928 A | | 1/1997 | Marmin et al. | 101/378 |
| 5,598,780 A | | 2/1997 | Marmin et al. | 101/415.1 |
| 5,613,440 A | | 3/1997 | Rau | 101/415.1 |
| 5,644,984 A | * | 7/1997 | Puschnerat et al. | 101/415.1 |
| 5,701,822 A | | 12/1997 | Metrope | 101/477 |
| 5,749,297 A | | 5/1998 | Récolet et al. | 101/415.1 |
| 5,809,890 A | | 9/1998 | Knauer et al. | 101/415.1 |
| 6,047,641 A | * | 4/2000 | Chagnon | 101/415.1 |
| 6,101,941 A | * | 8/2000 | Aubert et al. | 101/415.1 |
| RE36,977 E | | 12/2000 | Rau | 101/415.1 |
| 2001/0015147 A1 | * | 8/2001 | Koppelkamm | 101/415.1 |

FOREIGN PATENT DOCUMENTS

| | | |
|---|---|---|
| DE | 44 28 109 A1 | 2/1995 |
| DE | 44 04 758 C2 | 8/1995 |
| DE | 44 15 683 C2 | 11/1995 |
| DE | 197 29 375 A1 | 1/1999 |
| EP | 0 639 454 B1 | 2/1995 |
| EP | 0 678 383 A1 | 10/1995 |
| EP | 0 734 859 A1 | 1/1996 |
| EP | 0 741 021 A1 | 3/1996 |
| GB | 2 286 365 A | 8/1995 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

Device for holding a flexible printing form along the circumference of a printing form cylinder, so that a leading edge of the printing form engages beyond a leading edge of a clamping channel extending across the circumferential surface of the cylinder, comprising at least one resilient holding element secured to an actuatable clamp shaft for fixing a trailing edge of the flexible printing form, said holding element being a spring element that is engageable behind the trailing edge of the printing form with play when the clamp shaft is actuated; a printing form cylinder having the holding device; a printing unit of a rotary printing machine having the holding device; and a printing unit of a rotary printing machine having a printing form cylinder including the holding device.

11 Claims, 6 Drawing Sheets

1
2
2
3
4
5
6
7
8
9
10
11
12
13
14
15
23
24
D
D'

DEVICE FOR CLAMPING PRINTING FORMS IN CLAMPING CHANNELS OF REDUCED SIZE

BACKGROUND OF THE INVENTION

Field of the Invention

The invention relates to a device for clamping printing forms in clamping channels of reduced size.

The published European Patent Document EP 0 639 454 B1 discloses a device with a retractable hook for holding a printing plate on a support cylinder in a rotary printing press, and a rotary printing press having such a device.

The device for holding a printing plate on a support cylinder in a rotary printing press is located on a support cylinder formed with an outer surface that is cylindrical to the rotary axis of the support cylinder, and with at least one inner longitudinal bore opening out onto the outer circumferential surface via a longitudinal slot. Within the longitudinal bore, a device is provided for retaining within the slot particularly a trailing end part of the printing plate which, with respect to the support cylinder, is otherwise held by a leading edge relative to a predefined direction of rotation of the support cylinder about the rotary axis thereof, the plate in the rolled up condition thereof being clamped onto the outer circumferential surface of the support cylinder. Furthermore, a hook-forming device is formed with at least one hook extending radially outwardly in relation to the rotary axis of the support cylinder, and opposite to the direction of rotation thereof. Furthermore, a device is provided for actuating the hook-forming device, which is at least partly disposed within the bore of the support cylinder and is suitable for moving the hook reciprocatingly in a controlled manner between a forward end position relative to the direction of rotation of the support cylinder for permitting hooking or unhooking of the rear or trailing end fold of a printing form on the hook, and a rearward end position relative to the direction of rotation of the support cylinder for exerting a tensile force opposite to the direction of rotation of the support cylinder on the rear or trailing end fold of the printing form that is hooked onto the hook, the hook then being retracted into the interior of the gap or slot relative to the outer circumferential surface of the support cylinder. The hook-forming device is furthermore recessed in the gap or slot, and the hook protrudes in the forward end position thereof over the outer circumferential surface of the support cylinder. The actuating device, during the movement from the forward end position to the rearward end position, is suitable for causing the hook to withdraw into the gap or slot and, during the movement from the rearward end position to the forward end position, for causing the hook to protrude relative to the outer circumferential surface of the support cylinder. The hook-forming device includes at least one longitudinally extending sheet having a first radially inward end area relative to the rotary axis of the support cylinder, that end area being firmly connected with a clamping bar in the interior of the bore, and a second longitudinally extending end area that is located radially outside relative to the rotary axis of the support cylinder and forms the hook, and elastically deforms the sheet between the first end area and the second end area thereof.

The published European Patent Document EP 0 678 383 A1 discloses a device for changing printing forms on rotary printing presses. Both ends of a printing form are received in the cylinder gap of a printing form cylinder, the surface of the printing form being wound around the printing form cylinder. This construction provides for a device for receiving a printing form A disposed at that time on the printing form cylinder, the device having received the printing form A located at that time on the printing form cylinder after the printing form A has been released from clamping devices of the printing form cylinder, as well as a device for feeding a new printing form B, which transports a new printing form B onto the printing form cylinder. The device disclosed therein is distinguished in that, at a slight distance from the surface of the printing form cylinder, horizontally displaceable holding elements fix a leading edge of the printing form to be fed, until remotely-controlled positionable pivotable holding devices position the leading edge of the printing form to be fed onto the surface of the printing form cylinder.

The published European Patent Document EP 0 734 859 A1 is concerned with a device for changing printing forms. A pivotable printing form loading unit includes both a printing form feed and a printing form plate removal section. The printing form loading unit is pivotable both into a working position at the cylinder gap of a printing form cylinder with clamping devices and into a loading position wherein the printing form loading unit is retracted from the working position. The printing form loading unit, which is pivotable into a vertical loading position, is swivellable onto a holding element whereon a receiving area is provided for a printing form to be removed from the printing form cylinder, as well as conveyor devices for a printing form to be installed on the printing form cylinder.

The published European Patent Document EP 0 741 021 A1 discloses a device for connecting holding elements with a cross member or traverse of a printing form cylinder. This connecting device permits a flexible printing form to be fixed on the circumference of the printing form cylinder of a rotary printing press, the leading edge of the flexible printing form extending across a leading edge of a cylinder gap of the printing form cylinder, and the trailing edge of the flexible printing form being fixable by at least one flexible holding element, which is actuatably mountable on the cross member and has a hook-shaped projection on the end thereof facing towards the circumference, and is characterized in that several holding elements mountable side by side are interlockable on the cross member with locking devices. The holding elements can be inserted vertically into guides on the cross member. The device is suitable for mounting printing forms without a tool.

SUMMARY OF THE INVENTION

Starting from the foregoing state of the art, it is an object of the invention to provide a device for clamping printing forms in clamping channels of reduced size which are formed in a printing form cylinder, wherein the mounting of an endless printing form on the printing form cylinder either manually or by automatic printing form feeding devices is facilitated and improved, respectively.

With the foregoing and other objects in view, there is provided, in accordance with a first aspect of the invention, a device for holding a flexible printing form along the circumference of a printing form cylinder, so that a leading edge of the printing form engages beyond a leading edge of a clamping channel extending across the circumferential surface of the cylinder, comprising at least one resilient holding element secured to an actuatable clamp shaft for fixing a trailing edge of the flexible printing form, the holding element being a spring element that is engageable behind the trailing edge of the printing form with play when the clamp shaft is actuated.

In accordance with another feature of the invention, the holding device includes a plurality of the resilient holding elements secured to the actuatable clamp shaft for fixing the trailing edge of the flexible printing form, the plurality of holding elements being individually disposed adjacent one another and being formed as spring elements, respectively, the spring elements being engageable behind the trailing edge of the printing form with play when the clamp shaft is actuated.

In accordance with a further feature of the invention, the spring elements are supported by individual support pins in a channel formed in the clamp shaft.

In accordance with an added feature of the invention, a considerable part of the length of the spring elements protrudes above the circumferential surface of the clamp shaft.

In accordance with an additional feature of the invention, an end of the spring element engaging behind the trailing edge of the printing form dips into a recess formed in a channel sidewall defining a channel formed in the printing form cylinder.

In accordance with yet another feature of the invention, an end of the spring element engaging behind the trailing edge of the printing form clamps the trailing edge in the direction of a radius of a channel sidewall defining a channel formed in the printing form cylinder.

In accordance with yet a further feature of the invention, the holding device includes an adjusting unit mounted on an end face of the printing form cylinder for actuating the clamp shaft via a clamp shaft projection.

In accordance with yet an added feature of the invention, the holding device includes a movable adjusting lever for actuating the clamp shaft, and a bracket for limiting the movement of adjusting lever.

In accordance with yet an additional feature of the invention, the holding device includes an adjusting unit for actuating the clamp shaft, the adjusting unit being mounted on the end face of the printing form cylinder.

In accordance with still another feature of the invention, the clamp shaft and three bearing webs therefor are received in a bore formed in the printing form cylinder.

In accordance with still a further feature of the invention, the holding device includes two end bearing plates for the clamp shaft, the clamp shaft being completely removable from the printing form cylinder when one of the two end bearing plates is removed.

In accordance with a second aspect of the invention, there is provided a printing form cylinder having a device for holding a printing form along the circumference thereof, the holding device having at least one of the foregoing features.

In accordance with a third aspect of the invention, there is provided a printing unit of a rotary printing press having a device for holding a printing form along the circumference of a printing form cylinder, the holding device having at least one of the foregoing features.

In accordance with a fourth aspect of the invention, there is provided a printing unit of a rotary printing press having a printing form cylinder including a device for holding a printing form along the circumference of the printing form cylinder, the holding device having at least one of the foregoing features.

The holding elements are individually disposed on a clamp shaft and, when the clamp shaft is actuated, engage reach behind the trailing edge of a printing form with play.

The advantages inherent in this technical solution considerably facilitate the installation of the printing forms either manually or by automatic printing form feeding devices, because the play between the spring elements which engage behind the trailing edge of the printing form permits movement of the printing form relative to the cylinder surface during the printing form mounting process, before the clamping device is actuated and the printing form is clamped. With the provided play, inaccuracies in printing form production can be compensated for readily without requiring a new printing form to be produced if the edges are not precisely angled-away.

In a further development of the idea underlying the invention, the spring elements are supported in the channel of the clamp shaft by individual support pins, of which a respective support pin is associated with a respective spring element. This construction permits the use of printing forms having a trailing edge that has not been manufactured precisely, because the individual spring elements can adapt more easily to any irregularities of the printing form trailing edge than spring elements that extend, for example, all the way over the entire width. Because the ends of the spring elements protrude over the surface of the clamp shaft, the spring elements have considerable elasticity. This is further supported in that the spring elements dip into a recess that extends along the printing form cylinder in axial direction in the area of the clamping channel and thus engage over a relatively large area under the trailing edge of the printing form to be mounted, so that the printing form remains relatively movable on the circumference of the printing form cylinder without leaving the clamping area of the spring element.

When an adjusting unit, which can be provided on the cylinder end face, is actuated for rotating the clamp shaft, the trailing edge of the printing form is moved in the direction of a projection on the leading edge of the clamping channel of the printing form cylinder. This considerably reduces the pressure-free space, and the printing form is fixed in an optimum position on the surface of the printing form cylinder.

The adjusting movement of the adjusting unit, which is formed, for example, as a pneumatic fast-action cylinder with a fast-action ventilating unit, is transferred to the clamp shaft attachment by an adjusting lever. The adjusting lever is enclosed by a bracket. The bracket can also serve for limiting the adjusting movement of the adjusting lever.

The clamp shaft, whereon the individual spring elements are disposed, is supported in the printing form cylinder at three support locations formed as annularly extending surfaces at both end faces and in the center of the cylinder to ensure smooth actuation of the clamp shaft. Through lateral openings on the cylinder, the clamp shaft can be pulled out completely from the printing form cylinder, laterally.

The device according to the invention can be used with particular advantage in printing form cylinders of rotary printing presses, whether sheet-fed or web-fed presses. The small remaining non-printing area at the clamping channel provides considerable economization of paper for printing plants.

Other features which are considered as characteristic for the invention are set forth in the appended claims.

Although the invention is illustrated and described herein as embodied in a device for clamping printing forms in clamping channels of reduced size, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 5*a* to 5*c* are three cross-sectional views taken at different locations along the longitudinal axis of the clamp shaft;

DESCRIPTION OF THE PREFERRED EMBODIMENTS

Figure 1:
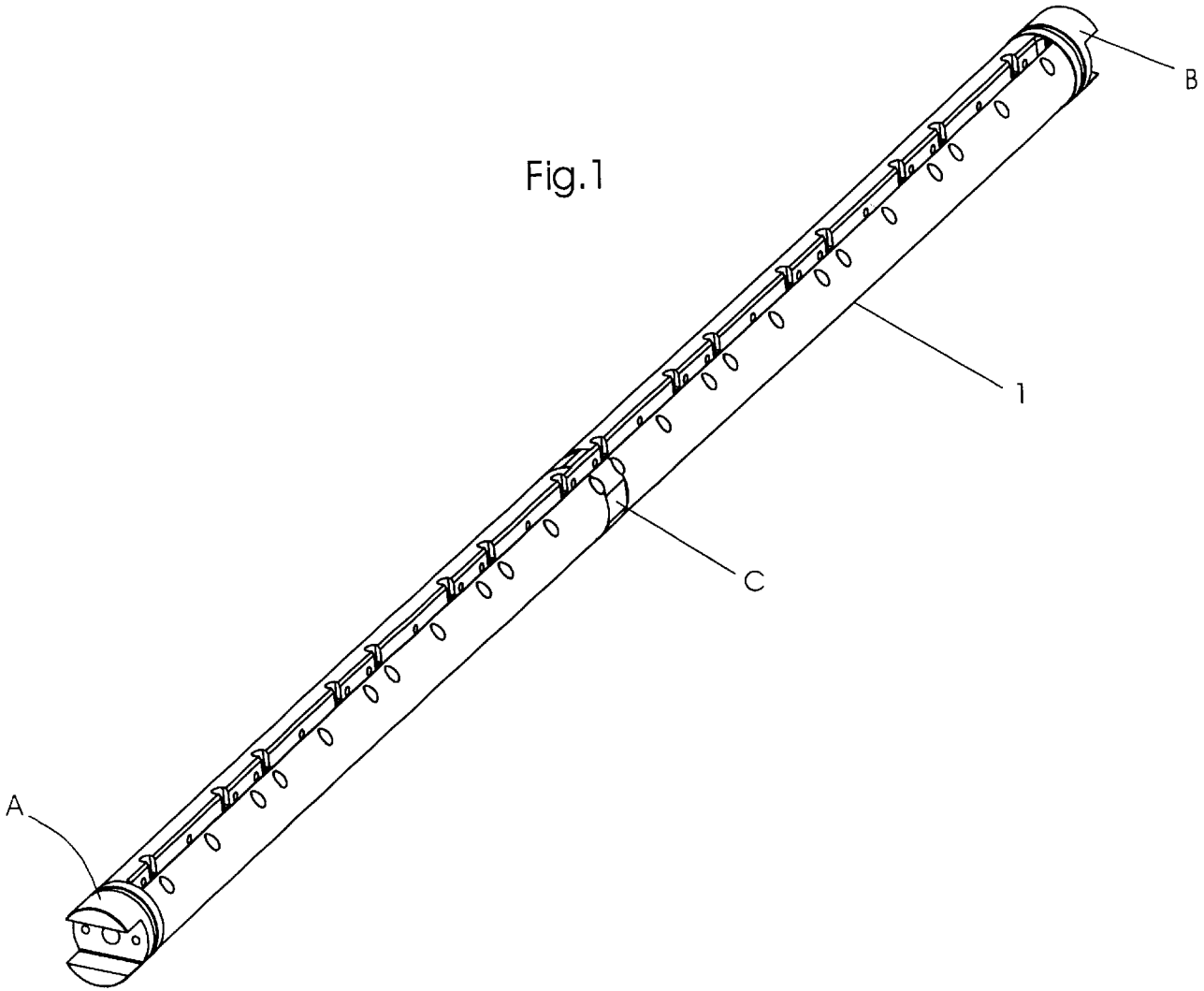
FIG. 1 is a longitudinally extending perspective view of a clamp shaft with three bearing webs or straps.

Referring now to the drawings and, first, particularly to FIG. 1 thereof, there is shown therein, in a perspective view, a longitudinal extension of a clamp shaft 1 with three bearing webs or straps A, B and C. Two of the bearing webs A and B are located at the outer ends of the shaft 1, and the third bearing web C is disposed in the center therebetween. The central bearing web C divides the clamp shaft 1 into two sections of equal length. A recess is formed in and extends along the axial extent of the clamp shaft 1, individual spring elements 2 being mounted therein adjacent one another on the clamp shaft 1, as shown, for example, in FIG. 2. In the perspective view according to FIG. 1, the spring elements 2 have been omitted in the interest of clarity.

Figure 2:
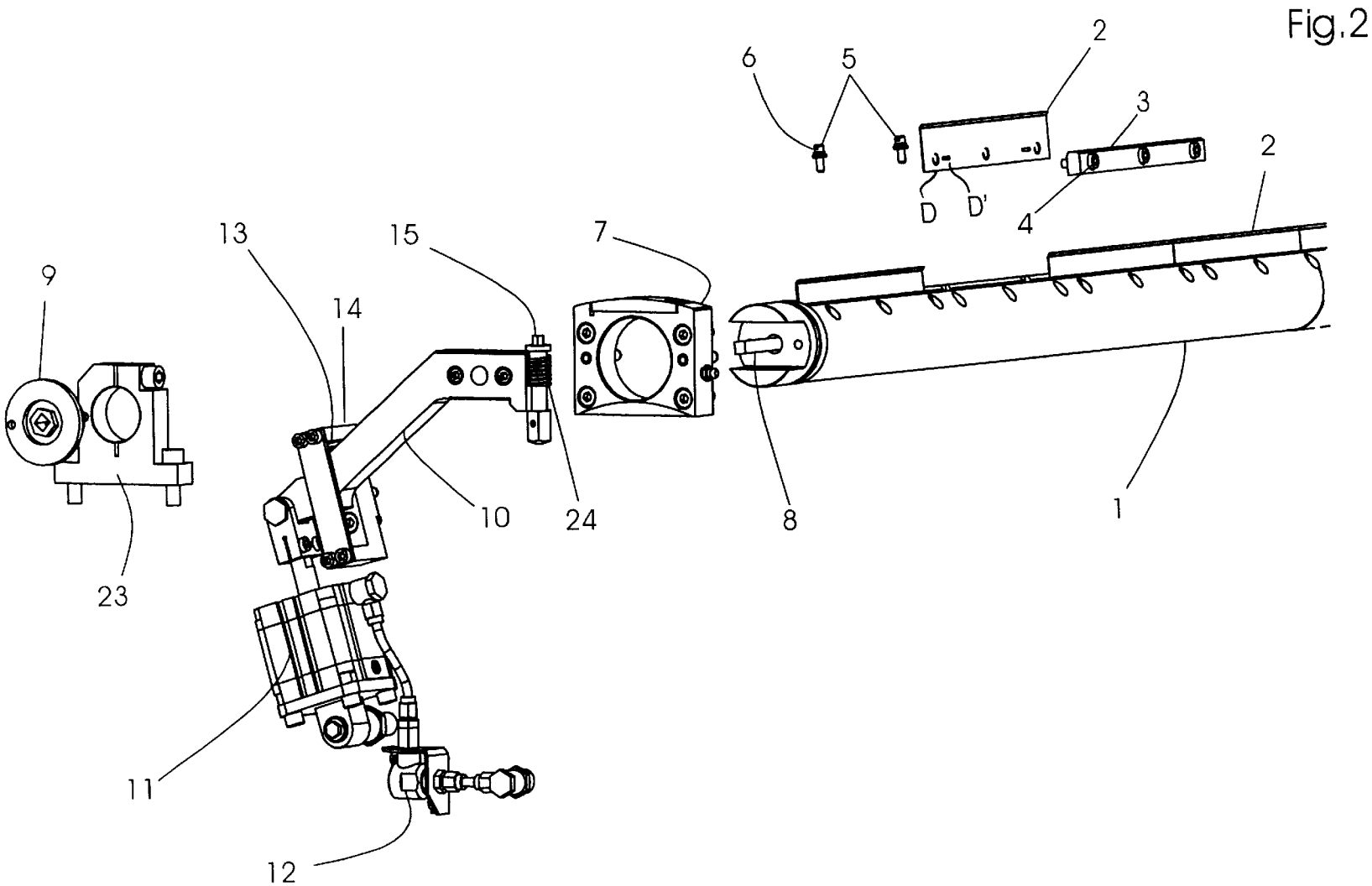
FIG. 2 is an exploded perspective view of the clamp shaft and an adjusting device therefor.

FIG. 2 is an exploded perspective view of the clamp shaft 1.

Figure 6:
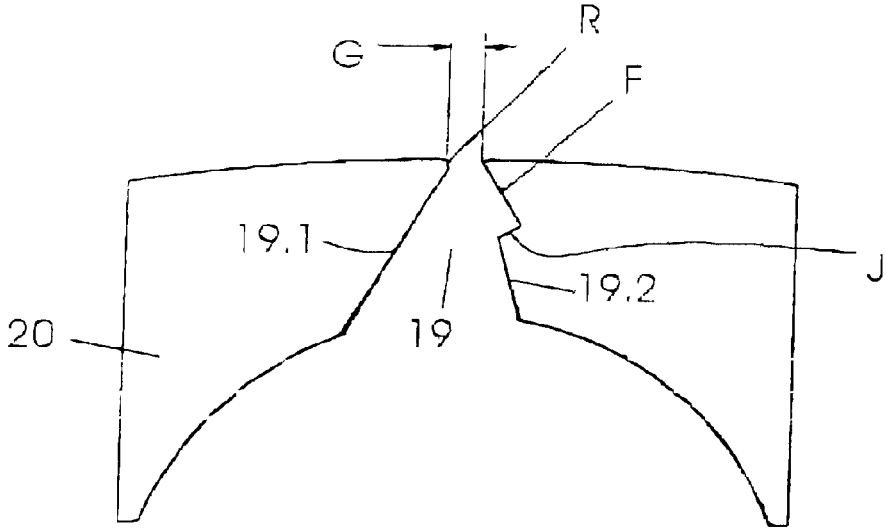
FIG. 6 is an enlarged diagrammatic fragmentary view of FIG. 5*c* showing surfaces defining the cylinder lock-up or clamping gap formed in the cylinder.
Figure 7:
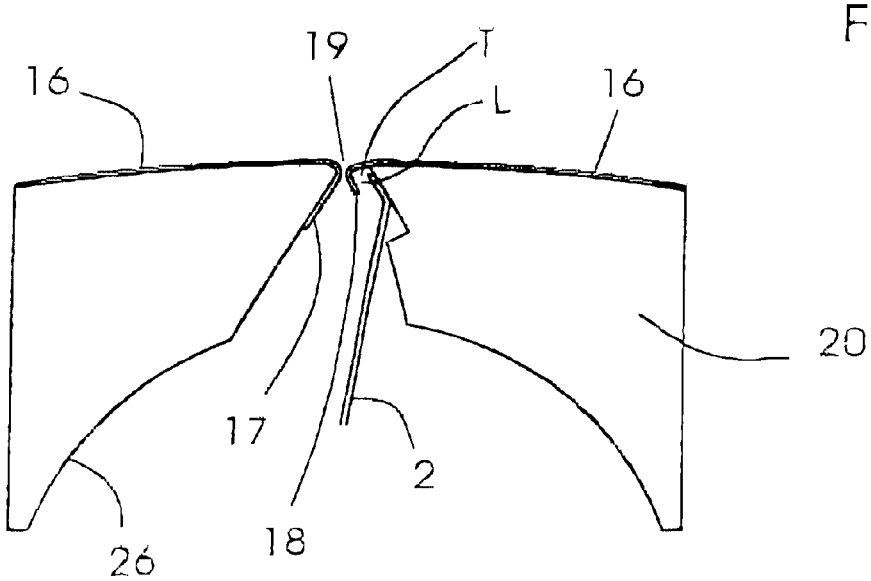
FIG. 7 is a view like that of FIG. 6, showing a leading and a trailing edge of a printing form hooked into the lock-up gap.

The clamp shaft 1 is formed with a slot or recess extending in the axial direction thereof for receiving therein the individual spring elements 2. The spring elements 2 are formed both with longitudinal slots D and vertically extending elongated holes D' through which the spring elements 2 can be fixed in the cylinder gap 19 (note FIGS. 6 and 7) of the printing form cylinder 20 by rigid support pins 3 which are fastened within the gap. For this purpose, the spring elements 2 are fastened to the support pins 3 by screws 5, which are provided with a collar attachment 6. In the illustrated embodiment of the clamp shaft 1, eight spring elements 2 are disposed adjacent one another and embedded, as shown in FIGS. 6 and 7, in the cylinder gap 19 of the printing form cylinder 20, the supporting pins 3 which support the spring elements 2 being received in the axially extending recess.

The clamp shaft 1, at the end faces A and B thereof, is provided with clamping projections 8, also referred to as torsion bars which, in the illustrated embodiment, are formed as a clamping projection with a square profile. Triangular or polygonal wedge profiles permitting a formlocking connection with an attachable clamping tool, or a pneumatically or hydraulically actuated clamping tool, are also feasible. In this regard, it is noted that a formlocking connection is one which connects two elements together due to the shape of the elements themselves, as opposed to a forcelocking connection, which locks the elements together by force external to the elements. The bearing web A illustrated in FIG. 2 is enclosed by an end bearing plate 7 that is formed with an opening and can be attached so as to align with a gap or recess formed in the end face of printing form cylinder 1.

The clamping projection 8 protruding from the bearing web A of the clamp shaft 1 is enclosed by an opening formed in an adjusting lever 10. To limit the movement of the adjusting lever 10 and to provide feedback regarding the clamping position of the clamp shaft 1, the adjusting lever 10 is enclosed by a bracket 14, which can be screwed laterally to the end face of the printing form cylinder. While the adjusting lever 10, at the lower end thereof, is connected by two screws 13 to an adjusting cylinder 11, a positioning element 15 is provided at the upper end of the adjusting lever 10, and has a spring 24 so that manual adjustment of adjusting lever 10 and, thus, the clamp shaft 1 is still possible via a projection provided on the upper side of the manual adjusting element 15. The projection, which is provided for a tool, on the upper side of the manual adjusting element 15 may be constructed, for example, as a socket wrench attachment with a square, hexagonal or larger polygonal wedge profile.

Figure 3:
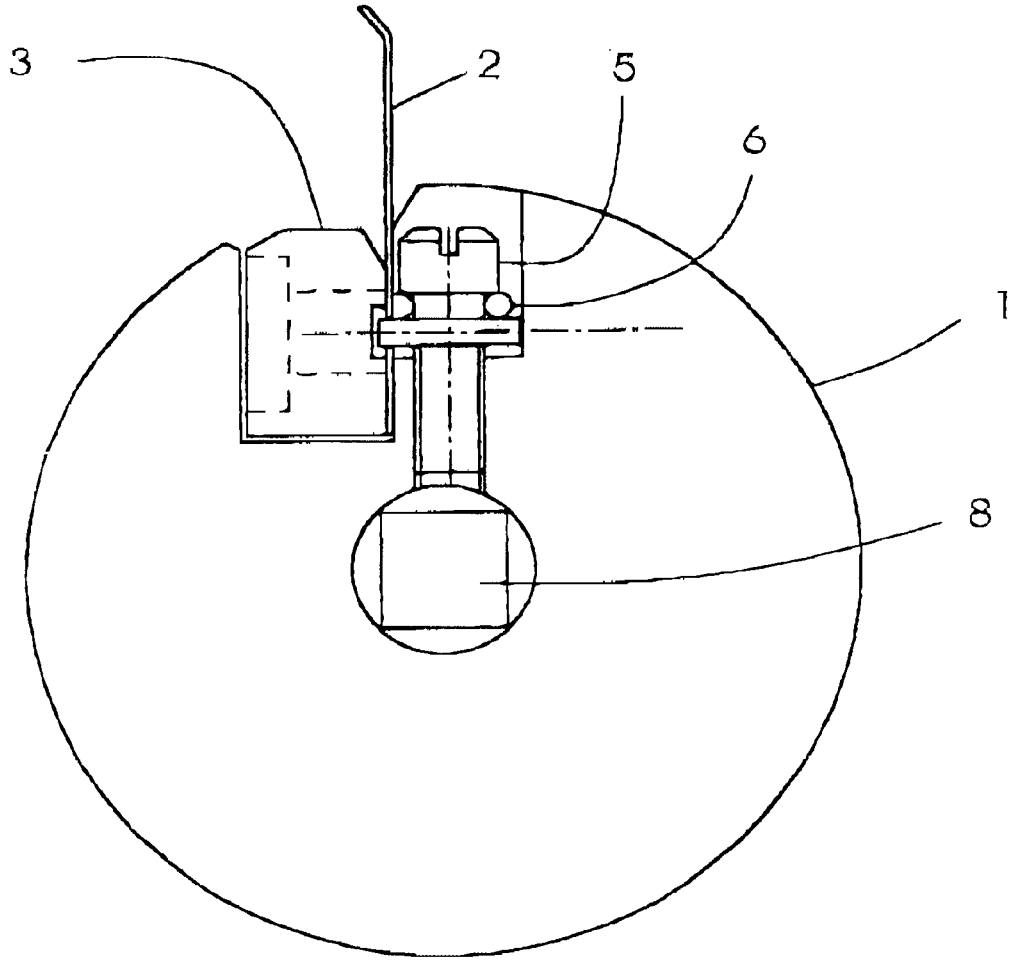
FIG. 3 is a diagrammatic enlarged cross-sectional view of the clamp shaft of FIG. 1.
Figure 4:
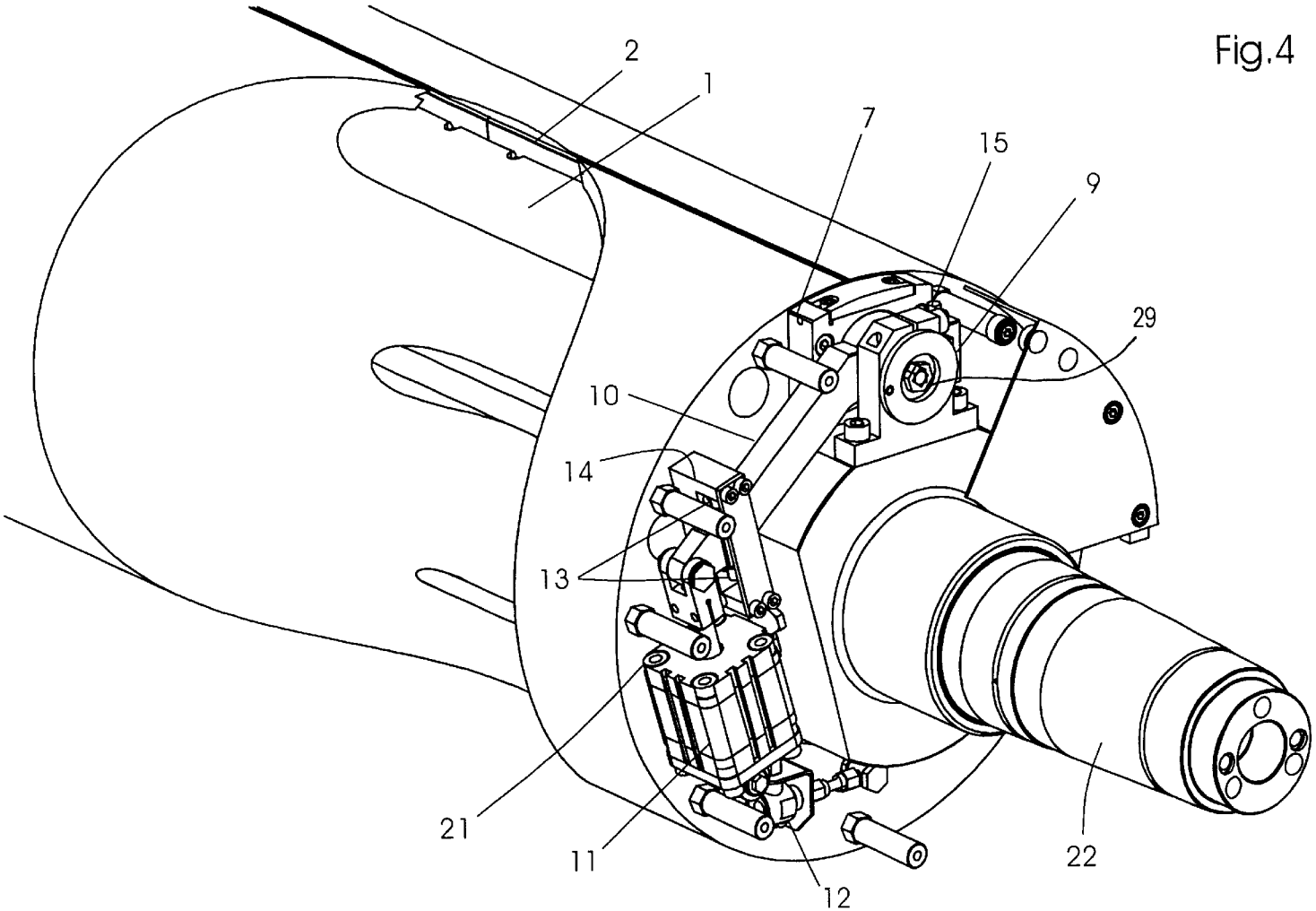
FIG. 4 is a much-enlarged fragmentary perspective view of a form cylinder showing an end face thereof.

The adjusting cylinder 11 provided at the lower end of FIG. 3 or 4 is supported on the cylinder end face via a yoke by the lower part of the adjusting lever 10 and is provided with a fast-action ventilating unit 12 to permit very rapid actuation. This minimizes the actuation time for the movement of the clamp shaft 1.

FIG. 3 is a cross-sectional view of a clamp shaft 1 at a slightly larger scale than that of FIG. 2.

The clamp shaft 1 is provided, along the axial extent thereof, with a recess wherein support pins 3 receiving spring elements 2 are embedded. The individual support pins 3, as shown in FIG. 3, are penetrated by screws 5, which are provided with a collar element 6. The screws 5 extend into a thread formed in the interior of clamp shaft 1. Through the intermediary of the screws 5 and the collars 6, the spring elements 2 are connected to respective support pins 3. Aligned with the axis of clamp shaft 1, the clamping projection 8 which, in the embodiment of FIG. 3 has a square cross section, is formed in the center of the clamp shaft 1.

FIG. 4 is a perspective top and end view of the printing form cylinder 20 showing the cylinder end face 21 thereof.

According to this view, an opening is provided on the end face 21 surrounding a cylinder journal 22, this opening being protectable against dirt by individual removable covers. In the cylinder 20, part of the circumferential surface of which is shown cut away in FIG. 4, spring elements 2 are embedded, which, as shown in FIG. 7, hold the trailing edge 18 of the printing form 16. To show the components of the clamping devices arranged below the removable sections, the coverings have been removed. These coverings can be fastened onto pin-shaped protruding bolts.

The cylinder journal 22 receives thereon the end bearing plate 7, which encloses the bearing web A of the clamp shaft 1. The upper lever arm of the adjusting lever 10 is shown in FIG. 4 between the end bearing plate 7 and a cap 9, in this case, the upper lever arm is covered by the cap 9, and encloses the clamp shaft projection 8. In front of the cap 9, a coupling 23 is shown. The adjusting lever 10 extends along the end face 21 of the printing form cylinder 20, the adjusting unit 11 which actuates the adjusting lever 10 being flange-mounted in the lower area of the end face 21. The adjusting unit 11, which is constructed, for example, as a pneumatic adjusting cylinder, can be provided with a fast-action ventilating unit 12 to permit a drastic reduction in the adjustment time periods.

Figure 5:
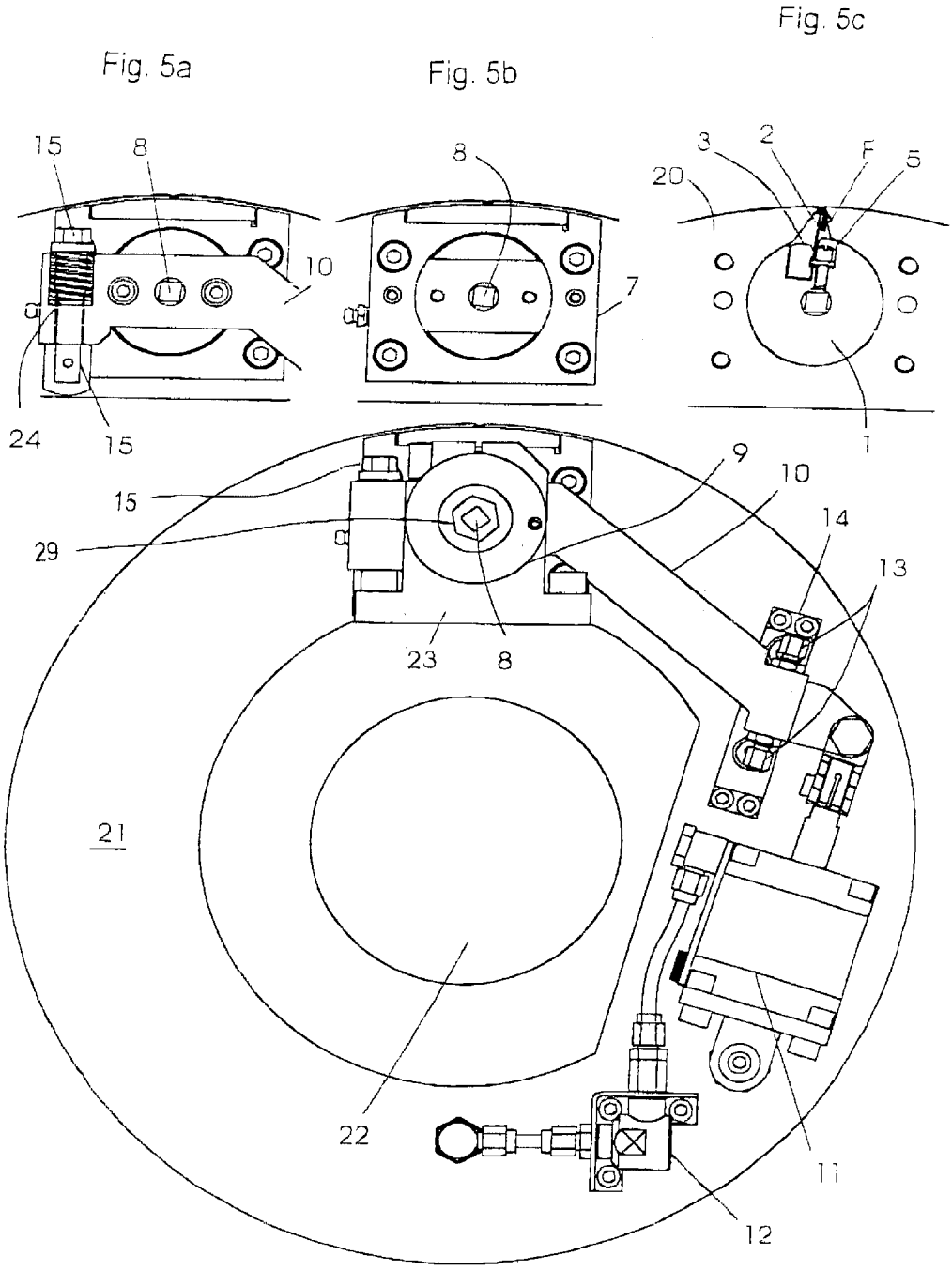
FIG. 5 is a further enlarged end view of the form cylinder of FIG. 4, showing the cylinder end face thereof.

On the cap or coupling 9, a tool attachment 29 is provided for a manual actuation device (note also FIG. 5). A bolt provided below the positioning element 15 can be rotated with the aid of a tool. This bolt is pretensioned by a spring 24 with which the clamp shaft attachment and the adjusting lever 10 can be actuated.

FIG. 5 is a side elevational view of the printing form cylinder end face 21, and three different cross-sectional views of the clamp shaft 1 are provided in FIGS. 5*a*, 5*b* and 5*c*.

The adjusting lever 10, at the lower end thereof, is connected to the adjusting unit 11 and, at the upper end thereof, as described hereinabove, encloses the clamp shaft projection 8 of clamp shaft 1. The adjusting lever 10 is enclosed by a bracket 14, which limits the adjustment path. In the elevational view of the end face 21 of the printing form cylinder 20, the coupling 23 is shown mounted on a shoulder above the journal 22 of the printing form cylinder 20. In the plane of the drawing that, according to FIG. 5, lies in front of the coupling 23 is the cap 9, which partially covers the coupling attachment element.

FIG. 5*a* shows the adjusting lever 10 with the coupling 23 above the cylinder journal 22 removed. The adjusting lever 10 encloses the clamp shaft projection 8 and includes a spring 24 located below the positioning element 15 and enclosing the latter. Rotating the positioning element 15 ensures actuation of the clamp shaft 1 upon the occurrence of a pressure drop in the, for example, pneumatic, adjusting unit 11, which can be a commercially available pneumatic cylinder. In FIG. 5*b*, the adjusting lever 10 is removed to reveal the end bearing plate 7. The end bearing plate 7 receives a bearing web A of the clamp shaft 1 and can be filled with grease or the like by a greasing nipple to ensure good mobility thereof. After removing the end bearing plate 7 from the cylinder end face 21, the clamp shaft 1 can be removed laterally from the bore formed in the printing form cylinder 20 without first requiring a major disassembly. The spring elements 2, the supporting pins 3, as well as the screwed connections 5 may remain on the clamp shaft 1.

FIGS. 6 and 7 illustrate the geometry of the clamping channel or cylinder gap in further detail.

FIG. 6 shows the channel or gap 19 formed in the printing form cylinder 20 on a larger scale than in FIG. 5*c*, for example. The channel or gap 19 is bordered or defined by a lefthand channel sidewall 19.1 and an opposite channel sidewall 19.2, wherein a recess F is formed. The pressure-free space G resulting between the opposite edges of the channel sidewalls 19.1 and 19.2 of the channel 19 is only a few millimeters across. From the interior surface 26 of the cylinder bore, the clamping channel 19 extends trapezoidally outwardly.

As shown in FIG. 7, the upper part of the spring element 2 can dip into the recess F to reach under the rear or trailing area of a printing form 16 within an area L, as indicated in FIG. 7. This leaves sufficient play T in channel 19 during the process of mounting printing form 16, in order to ensure the correct insertion of the printing form trailing edge 18 into the channel 19. Even if the angled-away area of printing form trailing edge 18 is too short or irregular or extends at an inclination, the spring elements 2, which are individually fastened to the clamp shaft 1, can reliably grasp individual areas of the trailing edge and clamp them after the actuation of the adjusting unit 11. During the clamping process, the printing form trailing edge 18 moves toward the printing form leading edge 17, which is secured via the radius R of the channel sidewall 19.1 of channel 19. If the clamp shaft 1 is rotated, the individually supported spring elements 2, respectively, adapt to the contour of the printing form trailing edge 18 to clamp it. Because the upper segments of spring elements 2 dip into the recess F, J, play T is produced between the surface delimiting recess F, J and the printing form trailing edge 18 to ensure that less precisely manufactured printing forms 16 are still correctly mounted in the channel 19.

I claim:

1. Device for holding a flexible printing form having a trailing edge, the device comprising:

a printing form cylinder formed with a circumferential surface and having a cylinder bore with an interior surface;

said printing form cylinder having a clamping channel formed therein extending across said circumferential surface of said printing form cylinder, said clamping channel having first and second non-parallel sidewalls and extending trapezoidally outwardly from said interior surface of said cylinder bore, said first a sidewall of said clamping channel being formed with a recess having a surface delimiting said recess;

an actuatable clamp shaft formed with a circumferential surface and disposed in said cylinder bore; and at least one resilient holding element formed as a spring element secured to said actuatable clamp shaft for fixing the trailing edge of the printing form;

said holding element having an upper part adapted to dip into said recess by rotation of said clamp shaft and adapted to engage behind the trailing edge of the printing form;

said surface delimiting said recess and the trailing edge of the printing form forming a play therebetween sufficient for mounting the printing form.

2. The holding device according to claim 1, wherein said at least one resilient holding element includes a plurality of resilient holding elements secured to said actuatable clamp shaft for fixing the trailing edge of the flexible printing form, said plurality of holding elements being individually disposed adjacent one another and being formed as spring elements, respectively, said spring elements being engageable behind the trailing edge of the printing form with said play when said clamp shaft is actuated.

3. The holding device according to claim 2, further comprising a channel formed in said clamp shaft and individual support pins, said spring elements supported by said individual support pins in said channel.

4. The holding device according to claim 2, wherein a considerable part of the length of said spring elements protrudes above the circumferential surface of said clamp shaft.

5. The holding device according to claim 1, wherein said second sidewall is opposite said first sidewall, and said upper part of said spring element adapted for engaging behind the trailing edge of the printing form clamps the trailing edge in the direction of a radius of said second sidewall.

6. The holding device according to claim 1, including an adjusting unit adapted to be mounted on an end face of the printing form cylinder for actuating said clamp shaft via a clamp shaft projection.

7. The holding device according to claim 1, including a movable adjusting lever for actuating said clamp shaft, and a bracket for limiting the movement of said adjusting lever.

8. The holding device according to claim 7, including an adjusting unit for actuating said clamp shaft, said adjusting unit being adapted to be mounted on an end face of the printing form cylinder.

9. The holding device according to claim 1, wherein said clamp shaft further comprises three bearing webs and said clamp shaft and said three bearing webs therefore are adapted to be received in the cylinder bore formed in the printing form cylinder.

10. The holding device according to claim 1, including two end bearing plates for said clamp shaft, said clamp shaft being adapted to be completely removable from the printing form cylinder when one of said two end bearing plates is removed.

11. Printing unit of a rotary printing press having a device for holding a printing form along the circumference of a printing form cylinder, according to claim 1.

* * * * *